US007397174B2

(12) United States Patent
Shioya

(10) Patent No.: US 7,397,174 B2
(45) Date of Patent: Jul. 8, 2008

(54) IMAGE DISPLAYING APPARATUS

(75) Inventor: Yasushi Shioya, Atsugi (JP)

(73) Assignee: Canon Kabushiki Kaisha, Tokyo (JP)

( * ) Notice: Subject to any disclaimer, the term of this patent is extended or adjusted under 35 U.S.C. 154(b) by 585 days.

(21) Appl. No.: 11/198,230

(22) Filed: Aug. 8, 2005

(65) Prior Publication Data

US 2006/0038954 A1 Feb. 23, 2006

(30) Foreign Application Priority Data

Aug. 17, 2004 (JP) ..... 2004-237165

(51) Int. Cl.
*H01J 1/88* (2006.01)
*H01J 19/42* (2006.01)

(52) U.S. Cl. ..... 313/257; 313/256; 313/258; 313/292; 313/306; 313/346 R; 313/495; 313/496; 313/497

(58) Field of Classification Search ..... 313/306, 313/309–310, 346, 351, 355, 495–497, 292–304, 313/252, 257, 258; 315/160–169.4
See application file for complete search history.

(56) References Cited

U.S. PATENT DOCUMENTS

| | | | | |
|---|---|---|---|---|
| 4,973,888 | A * | 11/1990 | Morimoto et al. | 315/366 |
| 5,859,508 | A * | 1/1999 | Ge et al. | 315/366 |
| 7,064,479 | B2 * | 6/2006 | Nakata et al. | 313/497 |
| 7,153,177 | B2 * | 12/2006 | Uemura et al. | 445/24 |
| 2004/0080469 | A1 * | 4/2004 | Murata et al. | 345/75.2 |
| 2006/0038483 | A1 | 2/2006 | Shioya | 313/497 |

FOREIGN PATENT DOCUMENTS

JP 2002-63859 2/2002

* cited by examiner

*Primary Examiner*—Nimeshkumar D. Patel
*Assistant Examiner*—Jose M Diaz
(74) *Attorney, Agent, or Firm*—Fitzpatrick, Cella, Harper & Scinto

(57) ABSTRACT

An image displaying apparatus which can easily fix an electrode plate to a predetermined position is provided. An electric potential of the electrode plate, a distance between the electrode plate and a first substrate, and a distance between the electrode plate and a second substrate are set so that a Coulomb attracting force acts in the direction in which the electrode plate is come into contact with a shoulder portion of a spacer.

4 Claims, 10 Drawing Sheets

IMAGE DISPLAYING APPARATUS

BACKGROUND OF THE INVENTION

1. Field of the Invention

The invention relates to an image displaying apparatus in which an electrode plate is interposed between two substrates arranged so as to face each other.

2. Related Background Art

Hitherto, studies of an image forming apparatus using electron-emitting devices have been being progressed. For example, there has been known a flat electron-beam (field-emission) displaying panel in which an electron source substrate on which a number of cold cathode electron-emitting devices are formed and an anode substrate having an anode electrode for accelerating electrons emitted from the electron-emitting devices and a phosphor are arranged in parallel so as to face each other and an internal space is exhausted to a vacuum. According to the flat electron-beam displaying panel, a lighter weight and a larger display screen can be realized as compared with those of a CRT (cathode ray tube) displaying apparatus which is widely used at present. An image of higher luminance and higher quality can be provided as compared with those of another flat display panel such as flat display panel using a liquid crystal, plasma display, electroluminescence display, or the like.

As an image displaying apparatus in which an electrode plate is interposed between two substrates arranged so as to face each other, an image displaying apparatus in which an electrode plate to control an electron emitted from an electron-emitting device is fixed to a predetermined position has been disclosed in Japanese Patent Application Laid-open No. 2002-63859 (paragraph [0044], FIGS. 6A and 6B) (Patent Document 1). Specifically speaking, an image displaying apparatus in which an electrode plate for correcting electrons is fixed to a step-forming portion of a spacer having a step portion by an adhesive agent has been disclosed.

According to the image displaying apparatus disclosed in Patent Document 1, if adhesion by the adhesive agent is imperfect, a positional deviation of the electrode plate occurs. If the spacer and the electrode plate are strictly fixed by the adhesive agent, there is also such an inconvenience that in a heating step during manufacturing of the displaying apparatus, a stress occurs in the adhesive portion of the spacer and the electrode plate, so that the spacer or the electrode plate is broken. It is considered that this is because such a phenomenon is caused by a difference between coefficients of thermal expansion of the spacer and the electrode plate.

SUMMARY OF THE INVENTION

It is an object of the invention to provide an image displaying apparatus which can solve the above inconvenience and can easily fix an electrode plate to a predetermined position in the displaying apparatus.

To accomplish the above object, according to the invention, there is provided an image displaying apparatus comprising:

a first substrate having a first conductor set as a first electric potential;

a second substrate having a second conductor set as a second electric potential different from the first electric potential;

an electrode plate arranged between the first substrate and the second substrate and set as a third electric potential; and a spacer which has a narrower width portion and a wider width portion, penetrates through the electrode plate at the narrower width portion, fixes the electrode plate in the wider width portion, and defines a spacing between the first substrate and the second substrate, wherein the wider width portion of the spacer is located between the first substrate and the electrode plate and satisfies the following relation:

$$V1/d1 > V2/d2$$

where,

V1: electric potential difference between the first electric potential and the third electric potential V2: electric potential difference between the second electric potential and the third electric potential d1: distance between the first substrate and the electrode plate d2: distance between the second substrate and the electrode plate.

According to the invention, a Coulomb attracting force which acts between the substrate (first substrate) that faces the surface on the wider width portion side of the electrode plate and the electrode plate is larger than a Coulomb attracting force which acts between the substrate (second substrate) which faces the surface on the narrower width portion side of the electrode plate and the electrode plate. Therefore, the electrode plate is come into contact with a step-forming portion of the spacer (portion at a boundary between the wider width portion and the narrower width portion) and held by the Coulomb attracting force which acts between the substrate which faces the surface on the wider width portion side of the electrode plate and the electrode plate and can be maintained at a predetermined position.

DETAILED DESCRIPTION OF THE PREFERRED EMBODIMENTS

An image displaying apparatus of the invention incorporates image displaying apparatuses such as liquid crystal displaying apparatus, plasma displaying apparatus, electron-beam displaying apparatus (for example, field-emission display (FED)), and the like. The electron-beam displaying apparatus is a preferable form when the invention is applied with respect to a point that the apparatus has an electron correcting electrode for controlling an electron emitted from an electron-emitting device toward an electron-beam excitement type phosphor layer.

An embodiment of the invention will now be described hereinbelow with reference to the drawings. In the embodiment, the electron-beam displaying apparatus (field-emission displaying apparatus: FED) is used as an image displaying apparatus.

Figure 1A:
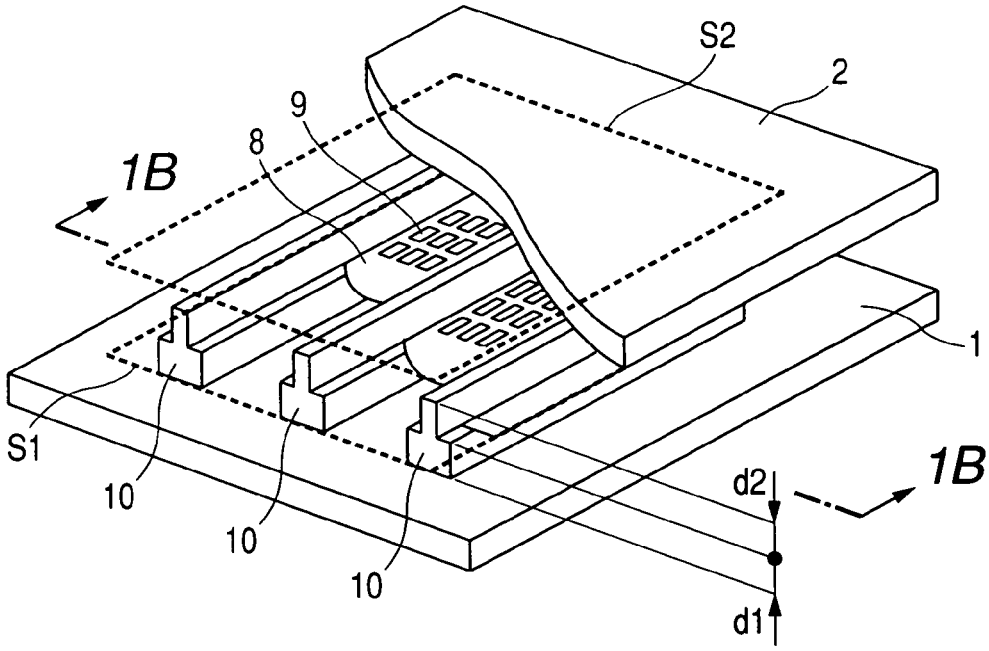
FIGS. 1A and 1B are explanatory diagrams showing a schematic structure of an image displaying apparatus of an embodiment of the invention.
Figure 1B:
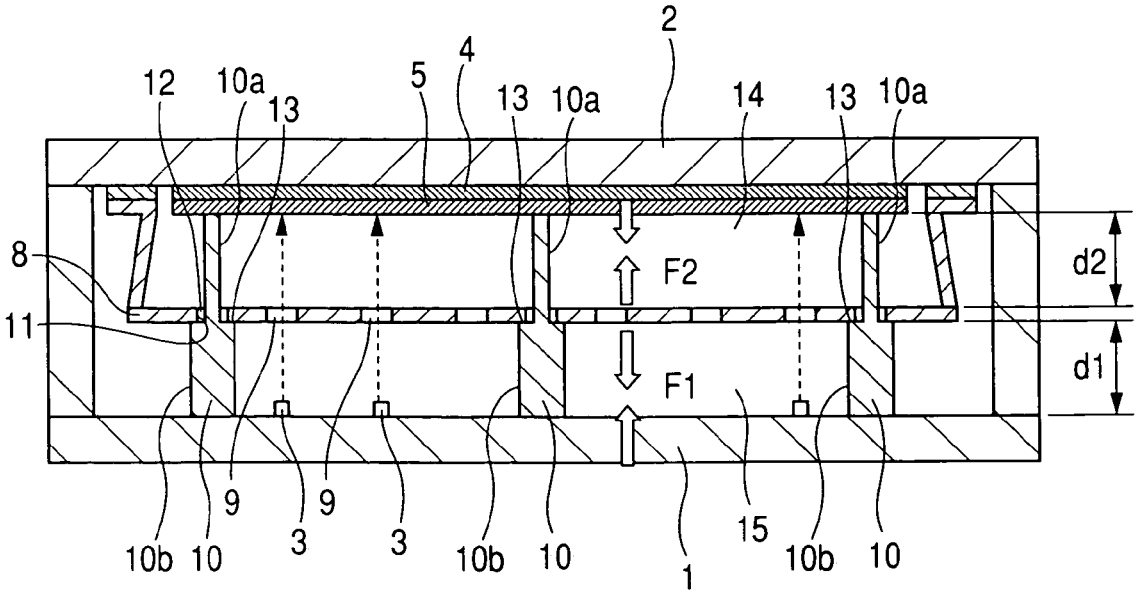

FIG. 1A is a perspective view showing a schematic construction of the image displaying apparatus of the embodiment. FIG. 1B is a cross sectional view taken along the line 1B-1B in FIG. 1A.

In FIGS. 1A and 1B, the image displaying apparatus includes a first substrate 1, a second substrate 2, electrode plates 8, and spacers 10.

The first substrate 1 has a first conductor set as a predetermined electric potential. The first substrate 1 is, for example, a substrate (rear plate) in which a plurality of electron-emitting devices 3 are formed in a matrix form onto the surface which faces the second substrate 2. In this case, the first conductor denotes the electron-emitting device.

The second substrate 2 has a phosphor member 4 constructing an image display surface and a second conductor 5 set as a specific electric potential different from that of the first conductor. In the case of using the electron-beam displaying apparatus as an image displaying apparatus, it is desirable that the specific electric potential is higher than the predetermined electric potential.

The second substrate 2 is, for example, a face plate for the electron-beam displaying apparatus. The second substrate 2 is arranged so as to face the electron-emitting devices 3. The phosphor member 4 is, for example, an electron-beam excitement type phosphor layer, is excited by the electron emitted from the electron-emitting device 3, and emits the light, thereby displaying an image. The second conductor 5 is a thin film conductor covering the phosphor member 4 and is a metal back made of, for example, Al.

The electrode plate 8 is, for example, a grid and is arranged between the first substrate 1 and the second substrate 2. The electrode plate 8 controls an electron beam emitted from the electron-emitting device 3 toward the phosphor member 4. The electrode plate 8 has holes 9 and positioning holes 11. Since the electrode plate 8 has the holes 9, the electrode plate 8 converges the electron emitted from the electron-emitting device 3 toward the phosphor member 4 or corrects its trajectory.

The spacer 10 is interposed between the first substrate 1 and the second substrate 2 and defines a spacing between the first substrate 1 and the second substrate 2. The spacer 10 has a narrower width portion 10*a*, a wider width portion 10*b*, and a shoulder portion (step-forming portion) 13 formed at a boundary between the narrower width portion 10*a* and the wider width portion 10*b*. The narrower width portion 10*a* penetrates through the positioning hole 11. A width of wider width portion 10*b* is wider than the positioning hole 11. The shoulder portion 13 is come into engagement with the electrode plate 8.

Figure 2:
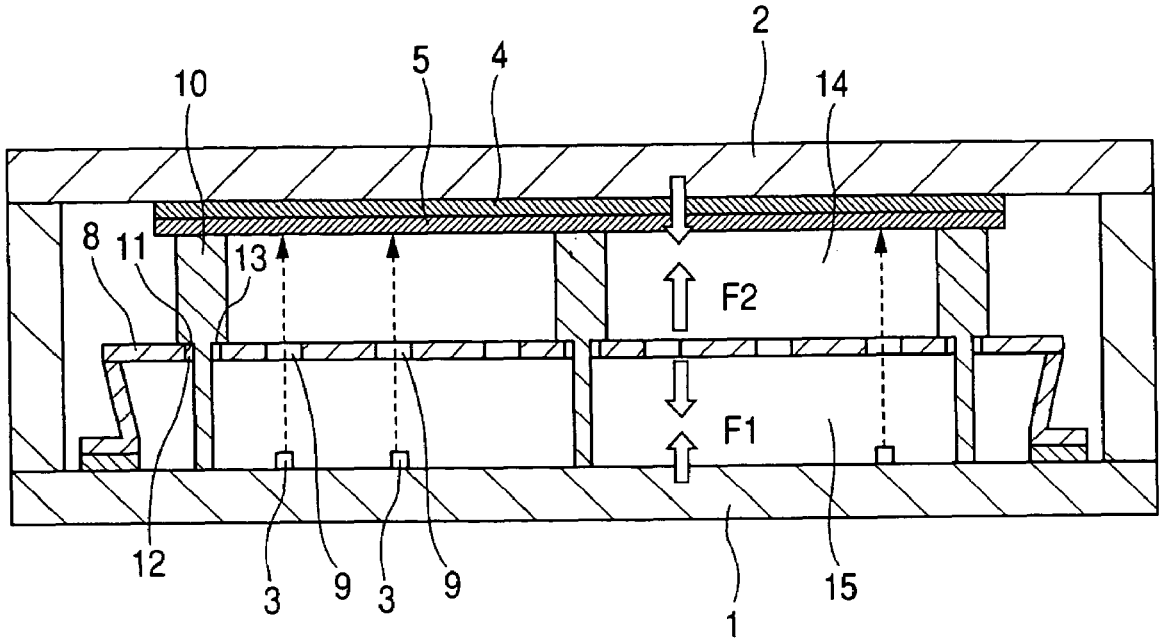
FIG. 2 is a cross sectional view showing a schematic structure of an image displaying apparatus of another embodiment of the invention.

The spacer 10 can be arranged so that the shoulder portion 13 faces the second substrate 2 as shown in FIGS. 1A and 1B or can be also arranged so that the shoulder portion 13 faces the first substrate 1 as shown in FIG. 2. FIG. 2 is a cross sectional view of another embodiment of an image displaying apparatus. In FIG. 2, the component elements having substantially the same constructions as those shown in FIGS. 1A and 1B are designated by the same reference numerals.

In the embodiment of FIGS. 1A and 1B, an electric potential (first electric potential) of the first conductor (electron-emitting device 3), an electric potential (second electric potential) of the second conductor 5, an electric potential (third electric potential) of the electrode plate 8, a distance (d1) between the electrode plate 8 and the first substrate 1, and a distance (d2) between the electrode plate 8 and the second substrate 2 are set so as to satisfy a relation (E1>E2), where, E1: electric field between the electrode plate 8 and the substrate (first substrate 1) which faces the surface of the wider width portion 10*b* side of the electrode plate 8

E2: electric field between the electrode plate 8 and the substrate (second substrate 2) which faces the surface of the narrower width portion 10*a* side of the electrode plate 8

The electric field E1 is equal to a value obtained by dividing a difference (V1) between the first electric potential and the third electric potential by the distance d1. The electric field E2 is equal to a value obtained by dividing a difference (V2) between the second electric potential and the third electric potential by the distance d2.

By the above settings, a Coulomb attracting force (F1) which acts between the substrate (first substrate) which faces the surface on the wider width portion 10*b* side of the electrode plate 8 and the electrode plate 8 is larger than a Coulomb attracting force (F2) which acts between the substrate (second substrate) which faces the surface on the narrower width portion 10*a* side of the electrode plate 8 and the electrode plate 8. Therefore, the electrode plate 8 is come into contact with the step-forming portion 13 of the spacer 10 and held by the Coulomb attracting force which acts between the substrate which faces the surface on the wider width portion side of the electrode plate 8 and the electrode plate 8 and is maintained at a predetermined position.

In the case of FIGS. 1A and 1B, the electric field between the electrode plate 8 and the second conductor 5 is smaller than that between the electrode plate 8 and the electron-emitting device as a first conductor. Therefore, F2 is smaller than F1 in FIGS. 1A and 1B. Thus, a force which is applied to the second conductor (metal back) made of the thin film is small and peel-off of the second conductor (metal back) can be prevented. Generally, it is known that when an electric field concentration structure such as a projection or the like exists on the cathode side having a low electric potential, a field emission occurs and a discharge or the like is induced. There is a case where such a projection occurs unexpectedly during the manufacturing step. However, in the case of the construction of FIG. 2 to which the invention is applied, such an inconvenience can be solved. That is, in the case of FIG. 2, on the contrary to FIGS. 1A and 1B, the electric field between the electrode plate 8 and the electron-emitting device as a first conductor is smaller than that between the electrode plate 8 and the second conductor 5. Therefore, even if an unexpected projection or the like occurs between the electron-emitting device 3 and the electrode plate 8 in the manufacturing step, the electron-emitting device can be protected without causing the problem of the unnecessary electron emission, discharge, or the like. In any of the above constructions, since the electrode plate 8 is pressed to the wider width portion of the spacer by the force generated by the electric field, a setting position of the electrode plate 8 is accurately determined at the position of the boundary portion between the wider width portion and the narrower width portion of the spacer.

Specific examples will be described in detail hereinbelow with respect to the electric potential of the electrode plate 8, the distance between the electrode plate 8 and the first substrate 1, and the distance between the electrode plate 8 and the second substrate 2.

If PD-200 is used as a material for the first substrate 1 and the second substrate 2, as a material for the electrode plate 8, a 426 alloy or a 48 alloy (both are the alloys of the Fe—Ni system) can be used as a material whose coefficient of line expansion is close to that of PD-200.

In FIGS. 1A, 1B, and 2, the Coulomb attracting force F1 which acts in a space 15 formed by the first substrate 1 and the electrode plate 8 and the Coulomb attracting force F2 which acts in a space 14 formed by the second substrate 2 and the electrode plate 8 are as follows.

$$F1=(½)\cdot(Q11\cdot E11)=(½)\cdot\epsilon S1\cdot(Vg/d1)^2$$

$$F2=(½)\cdot(Q12\cdot E12)=(½)\cdot\epsilon S2\cdot(Va-Vg)/d\,2^2$$

where,

- Q11: electricity amount between the first substrate 1 and the electrode plate 8
- E11: electric field between the first substrate 1 and the electrode plate 8
- Q12: electricity amount between the second substrate 2 and the electrode plate 8
- E12: electric field between the second substrate 2 and the electrode plate 8
- ϵ: dielectric constant of a vacuum
- Va: electric potential difference between the electron-emitting device 3 and the second conductor 5
- Vg: electric potential difference between the electron-emitting device 3 and the electrode plate 8
- d1: distance between the first substrate 1 and the electrode plate 8
- S1: area of the electrode plate 8
- d2: distance between the second substrate 2 and the electrode plate 8
- S2: area of the voltage applying portion of the second substrate 2

The electric potential of the electron-emitting device 3 is set to 0V (hereinbelow, there is also a case where Va is referred to as an applied voltage to the second conductor and Vg is referred to as an applied voltage to the electrode plate).

In the embodiment, as shown in FIGS. 1A and 1B, when the surface on the wider width portion 10*b* side of the electrode plate 8 faces the first substrate 1, the electric potential Vg of the electrode plate 8, the distance d1 between the electrode plate 8 and the first substrate 1, and the distance d2 between the electrode plate 8 and the second substrate 2 are set so as to satisfy F1>F2, that is, Q11·E11>Q12·E12.

When the surface on the wider width portion 10*b* side of the electrode plate 8 faces the second substrate 2, the electric potential Vg of the electrode plate 8, the distance d1 between the electrode plate 8 and the first substrate 1, and the distance d2 between the electrode plate 8 and the second substrate 2 are set so as to satisfy F2>F1, that is, Q12·E12>Q11·E11. In any one of the cases of FIGS. 1A and 1B and FIG. 2, since Q11 and Q12 indicate charges on the front and back surfaces of the electrode plate 8 and Q11 is equal to Q12, they can be ignored in the relative relation (magnitude relation) between F1 and F2.

A magnitude |F1−F2| of the Coulomb force which acts on the electrode plate 8 is calculated by using the following values which are typical to respective parameters. Specifically speaking, The dielectric constant of the vacuum:

$$\epsilon=8.85E-12[F/m]$$

The applied voltage to the second conductor 5:

$$Va=10\ [kV]$$

The applied voltage to the electrode plate 8:

$$Vg=6\ [kV]$$

The distances between the substrates and the electrode plate:

$$d1=d2=2\ [mm]$$

The areas of the substrate and the electrode plate:

$$S1=S2=80000\ [mm^2]$$

In this case, |F1−F2|=17.7 [N]

Assuming that the 426 alloy or 48 alloy is used as a material of the electrode plate 8 and its thickness is equal to 0.15 [mm], it is presumed that the tare weight of the electrode plate 8 is equal to about 10 [N]. Therefore, the Coulomb force (|F1−F2|) is sufficiently larger than the tare weight of the electrode plate 8. Consequently, for example, by properly setting the direction from the wider width portion toward the narrower width portion of the spacer 10, the electric potential of the electrode plate 8, the distance between the electrode plate 8 and the first substrate 1, the distance between the electrode plate 8 and the second substrate 2, and the like, the electrode plate 8 can be held in the state where it is in contact with the shoulder portion 13.

In the embodiment, the phosphor layer 4 is provided on the second substrate 2, the first substrate 1 has the electron-emitting devices 3 formed on the surface which faces the second substrate 2, and the electric potential of the second conductor 5 is higher than that of the electron-emitting device 3. Since the electrode plate 8 has been defined so as to have a desired electric potential adapted to control the electron emitted from the electron-emitting device 3 toward the phosphor layer 4 (for example, to converge the electron emitted from the electron-emitting device 3 or correct its trajectory), the position of the electrode plate 8 for controlling the electron is fixed by the shoulder portion (step-forming portion) 13 of the spacer by the Coulomb force.

Therefore, the deviation of the electron beam and the deterioration of discharge-resistant performance which are caused by the positional deviation of the electrode plate 8 can be prevented. Thus, the deterioration of image displaying performance can be prevented.

Figure 3:
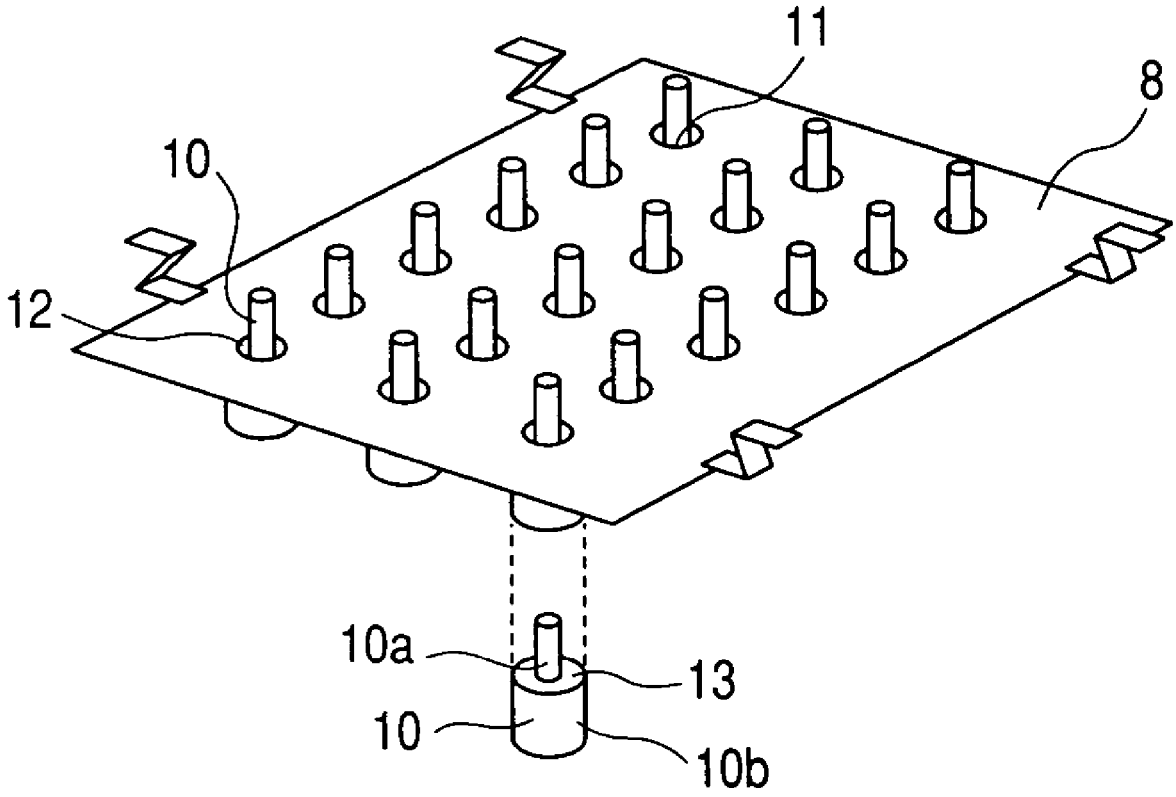
FIG. 3 is a perspective view showing a schematic structure of a part of the image displaying apparatus of another embodiment of the invention.
Figure 4:
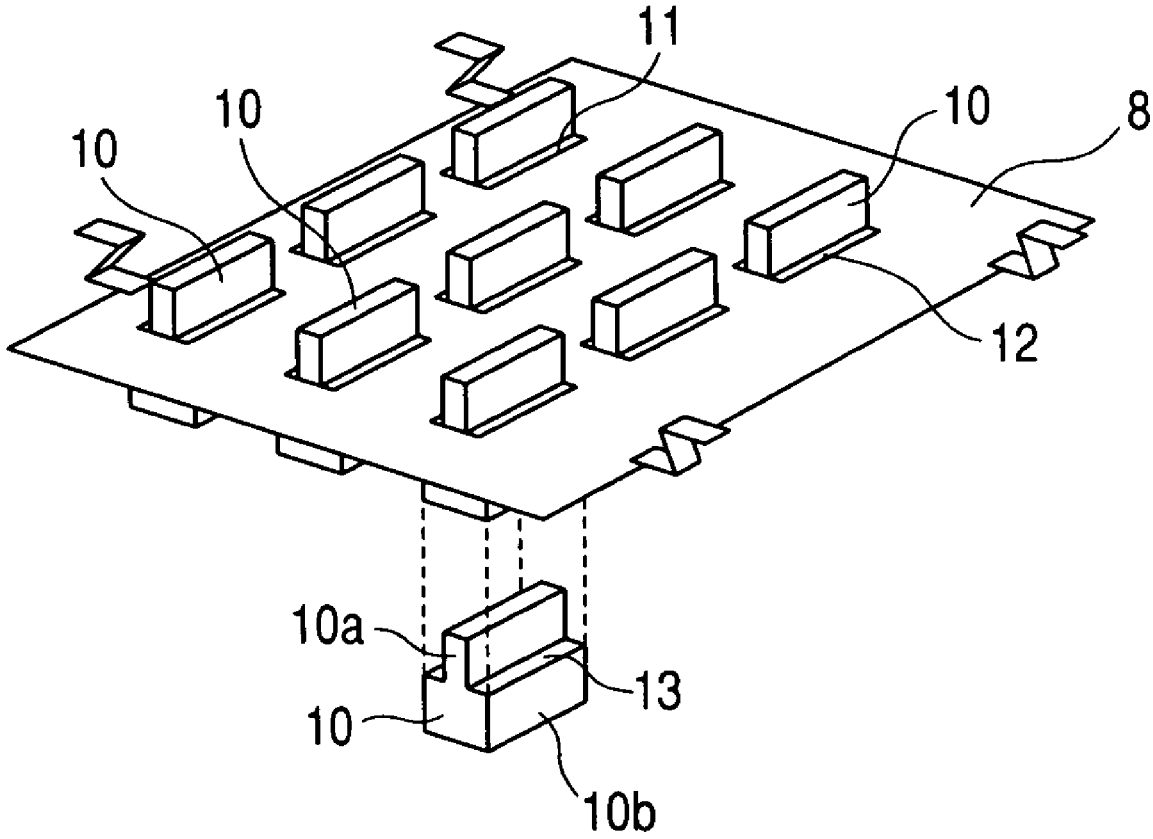
FIG. 4 is a perspective view showing a schematic structure of a part of the image displaying apparatus of another embodiment of the invention.
Figure 5A:
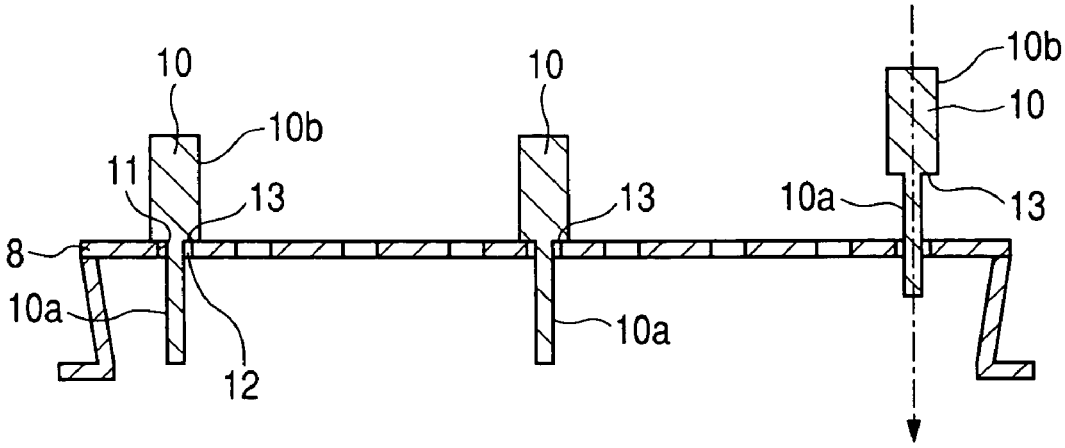
FIGS. 5A and 5B are cross sectional views for explaining one manufacturing step of the image displaying apparatus shown in FIGS. 1A and 1B.
Figure 5B:
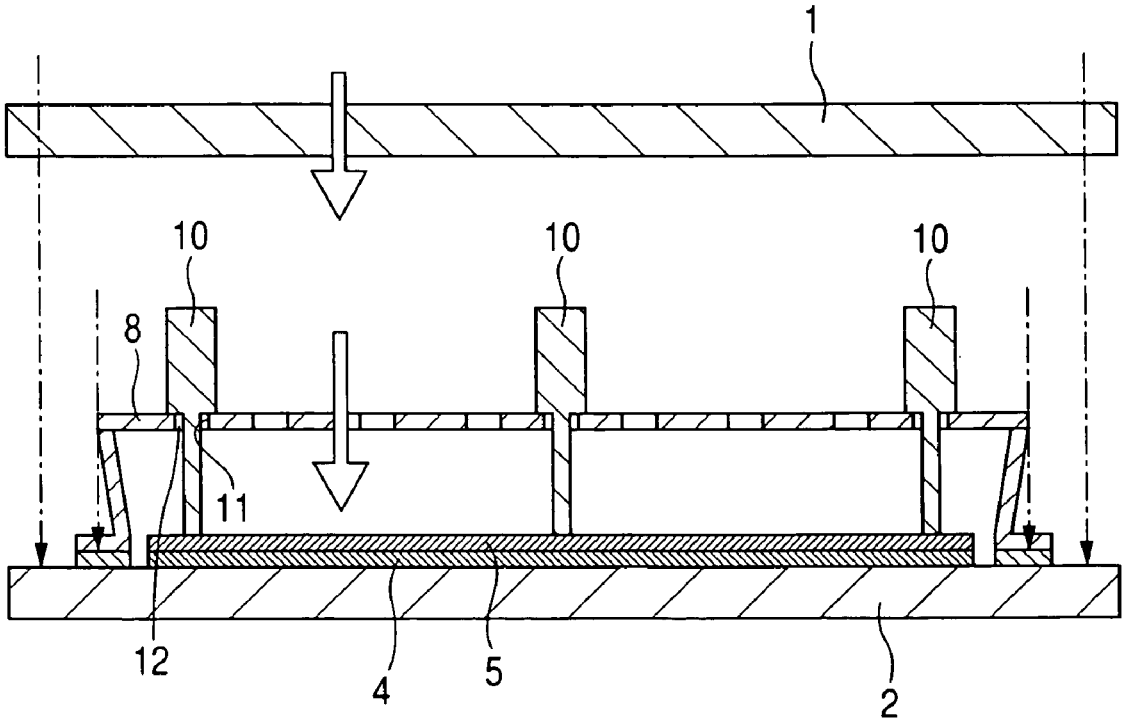
Figure 6A:
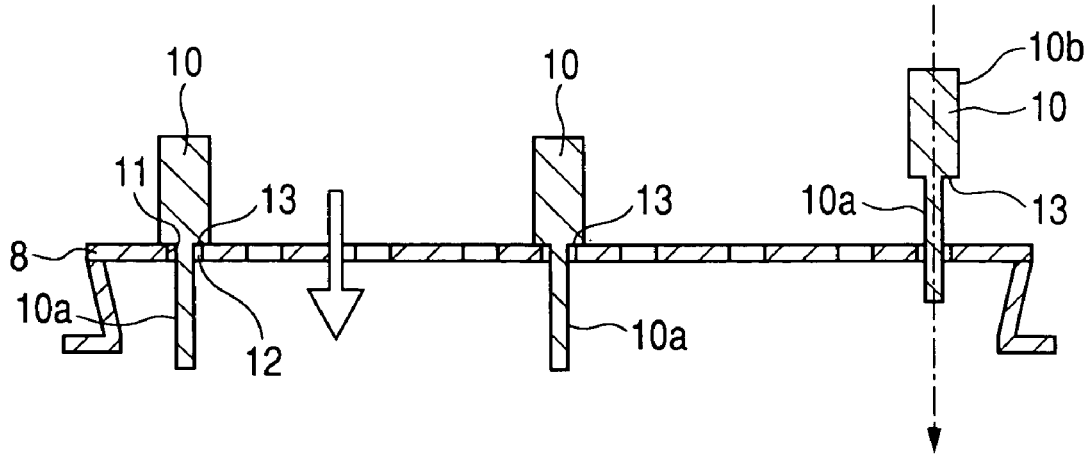
FIGS. 6A and 6B are cross sectional views for explaining one manufacturing step of the image displaying apparatus shown in FIG. 2.
Figure 6B:
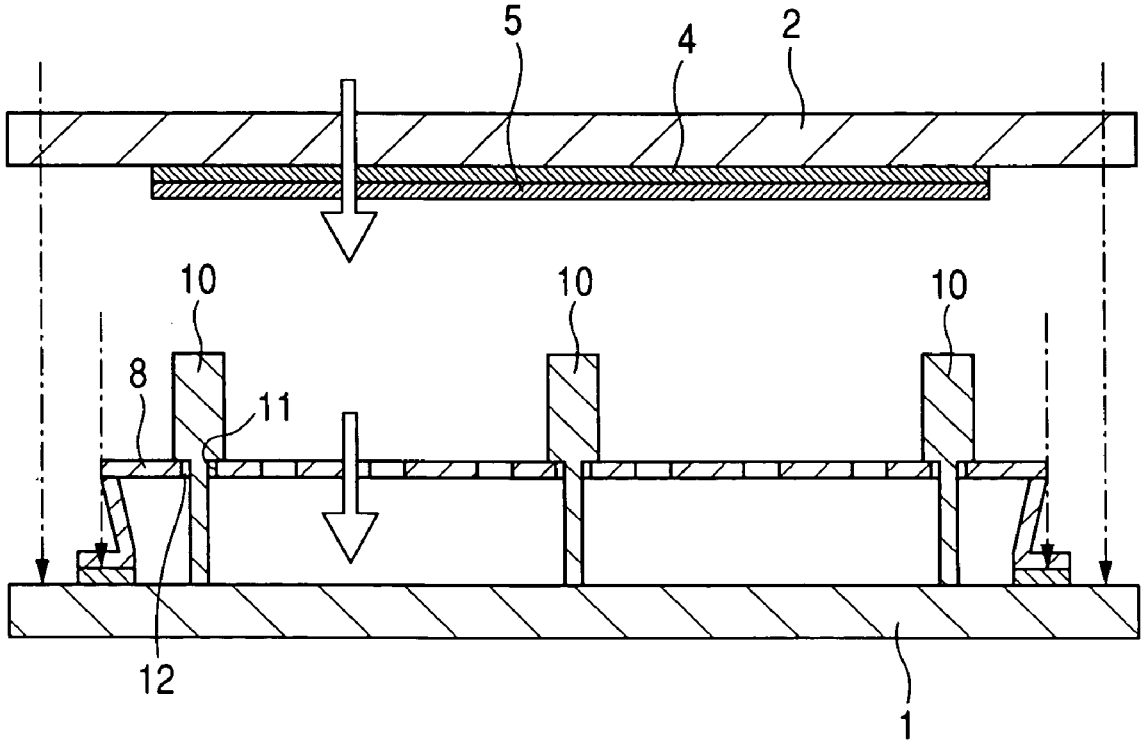
Figure 7A:
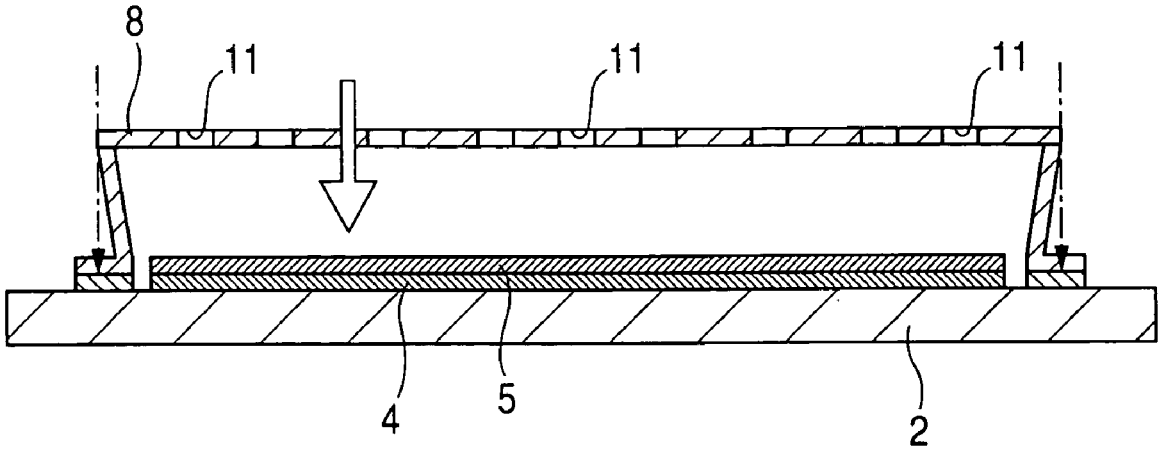
FIGS. 7A and 7B are cross sectional views for explaining another manufacturing step of the image displaying apparatus shown in FIGS. 1A and 1B.
Figure 7B:
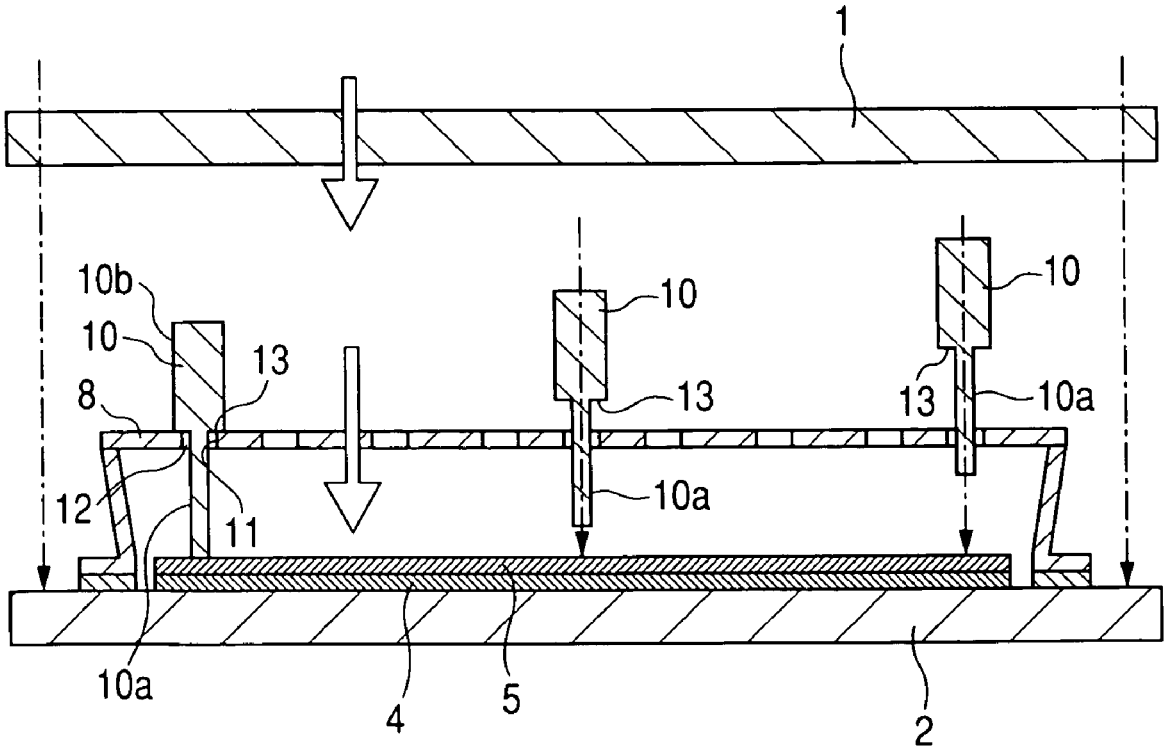
Figure 8A:
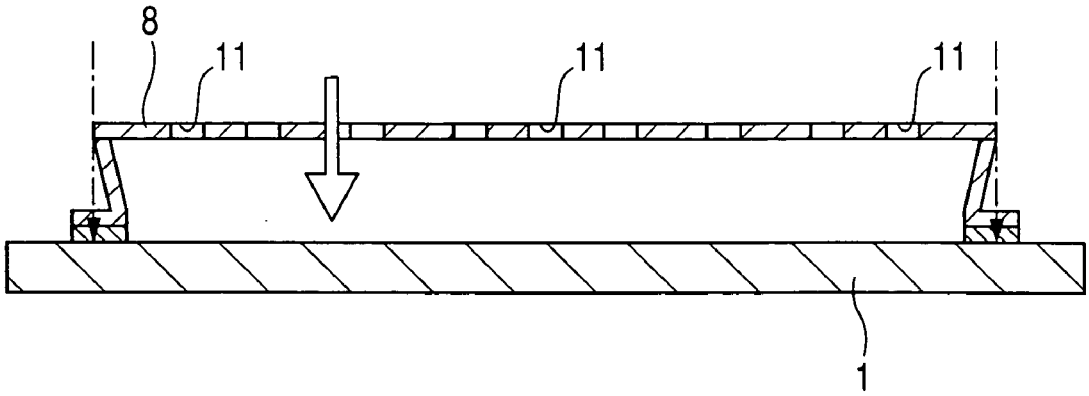
FIGS. 8A and 8B are cross sectional views for explaining another manufacturing step of the image displaying apparatus shown in FIG. 2.
Figure 8B:
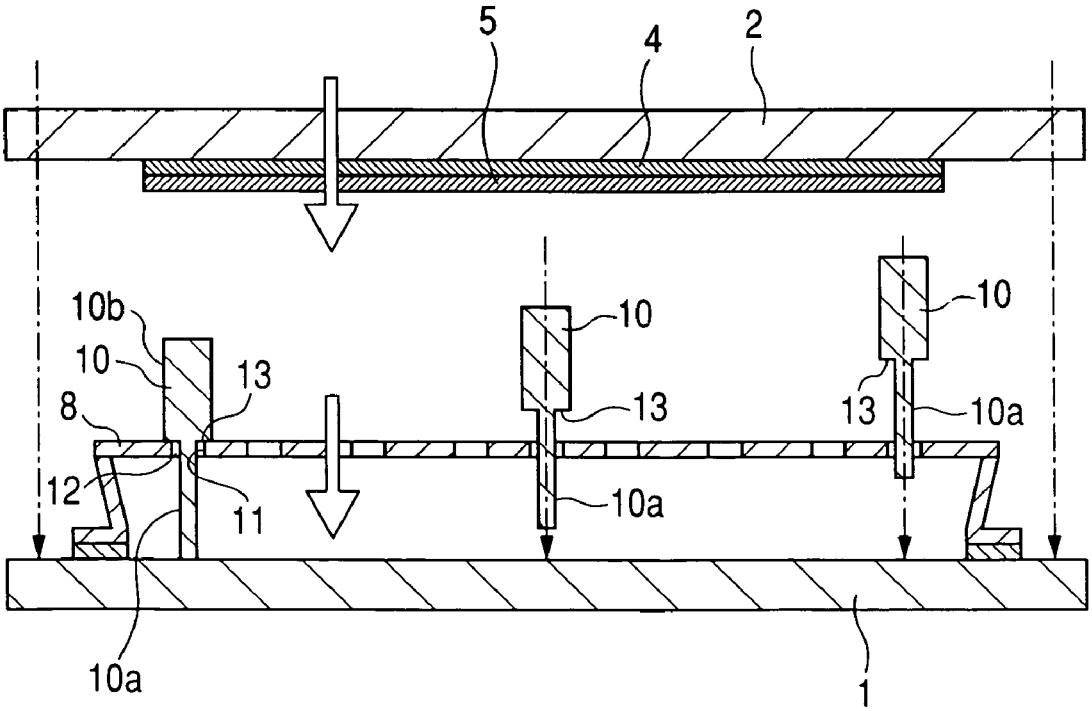

The shape of the spacer 10 is not limited to the shape in which two prisms having different widths as shown in FIGS. 1A, 1B, and 2 are combined but can be properly changed. FIGS. 3 and 4 are perspective views showing other examples of the spacer 10. In FIGS. 3 and 4, the component elements having substantially the same constructions as those shown in FIGS. 1A and 1B are designated by the same reference numerals.

The shape of the spacer 10 can be set to, for example, a shape in which two circular cylinders having different diameters as shown in FIG. 3 or, as shown in FIG. 4, a shape in which although two prisms having different widths are combined, its length is shorter than that of the spacer 10 shown in FIGS. 1A, 1B, and 2. It is desirable that a shape of the positioning hole 11 formed in the electrode plate 8 is properly changed in accordance with the shape of the spacer 10.

The image displaying apparatus shown in FIGS. 1A, 1B, and 2 can be manufactured by, for example, one of the following two methods. FIGS. 5A, 5B, 6A and 6B are cross sectional views for explaining a first manufacturing method. FIGS. 7A, 7B, 8A and 8B are cross sectional views for explaining a second manufacturing method. In FIGS. 5A to 8B, the component elements having substantially the same constructions as those shown in FIGS. 1A and 1B are designated by the same reference numerals.

First, the first manufacturing method will be described. As shown in FIGS. 5A, 5B, 6A and 6B, in the state where a clearance 12 exists between the inside surface of the positioning hole 11 and the narrower width portion 10*a*, the narrower width portion 10*a* is fitted into the positioning hole 11, thereby allowing the electrode plate 8 to be come into contact with the shoulder portion 13 of the spacer 10 (refer to FIGS. 5A and 6A). After the electrode plate 8 on which the spacers 10 have been attached is positioned and fixed to the first substrate 1 or the second substrate 2, the second substrate 2 or the first substrate 1 is positioned and fixed to the first substrate 1 or the second substrate 2 (refer to FIGS. 5B and 6B).

The second manufacturing method will now be described. As shown in FIGS. 7A, 7B, 8A and 8B, after the electrode plate 8 is positioned and fixed to the first substrate 1 or the second substrate 2 (refer to FIGS. 7A and 8A), the narrower width portion 10*a* is fitted into the positioning hole 11, thereby allowing the shoulder portion 13 to be come into contact with the electrode plate 8. After that, the second substrate 2 or the first substrate 1 is positioned to the electrode plate 8 and the spacer 10 and fixed to the first substrate 1 or the second substrate 2 (refer to FIGS. 7B and 8B).

Figure 9A:
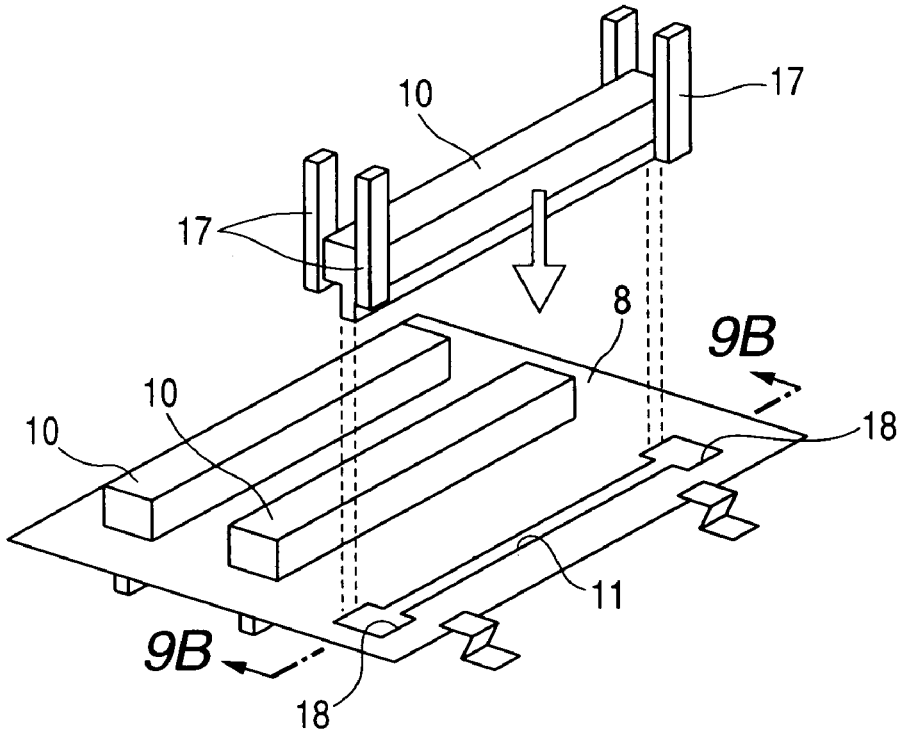
FIGS. 9A and 9B are explanatory diagrams showing a schematic structure of a part of the image displaying apparatus of another embodiment of the invention.
Figure 9B:
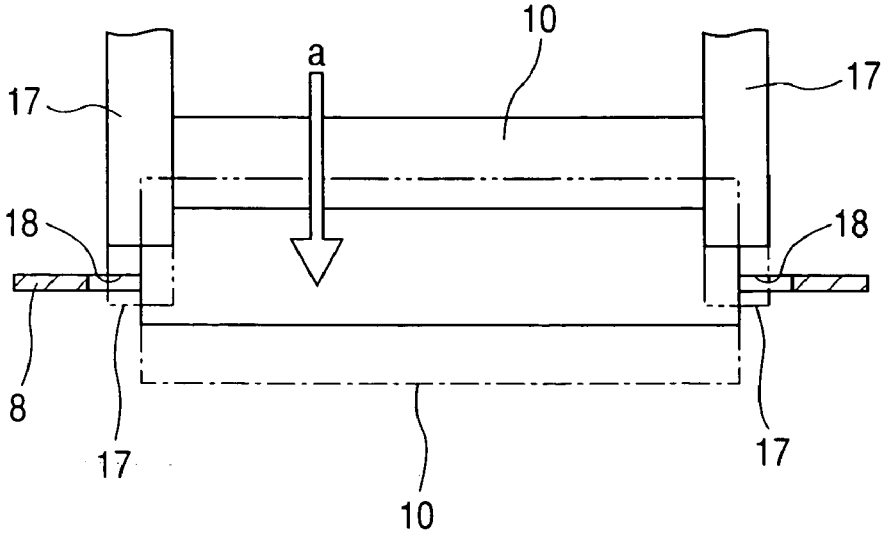

From a viewpoint of improving working efficiency, it is preferable that escaping holes (escaping portion) 18 of grip units 17 of the spacer 10 are formed on the electrode plate 8 in consideration of the automatization of the assembling work as shown in FIGS. 9A and 9B.

FIG. 9A is a perspective view for explaining the electrode plate 8, spacer 10, grip units 17, and escaping holes 18. FIG. 9B is a cross sectional view taken along the line 9B-9B in FIG. 9A. In FIG. 9B, an alternate long and two dashes line shows a state where the spacer 10 and the grip units 17 are moved in the direction shown by an arrow (a). In FIGS. 9A and 9B, the component elements having substantially the same constructions as those shown in FIGS. 1A and 1B are designated by the same reference numerals.

Explanation will now be supplemented with reference to FIGS. 9A and 9B. Hitherto, the operation for allowing the narrower width portion 10*a* of the spacer 10 to penetrate through the positioning hole 11 of the electrode plate 8 has such a problem that a human load is heavy because of a large working amount and its elaborateness. It is, therefore, demanded to improve the working efficiency by reducing the working load.

Therefore, a method whereby the grip units 17 allow the narrower width portion 10*a* to automatically penetrate through the positioning hole 11 in the state where the spacer 10 is gripped is considered. However, when the grip units 17 allow the narrower width portion 10*a* to automatically penetrate through the positioning hole 11, if the grip units 17 are come into contact with the electrode plate 8, a possibility that it is difficult for the grip units 17 to allow the narrower width portion 10*a* to penetrate through the positioning hole 11 occurs.

In the embodiment shown in FIGS. 9A and 9B, since the escaping holes 18 of the grip units 17 are formed on the electrode plate 8, such a situation that the grip units 17 are come into contact with the electrode plate 8 when the operation in which the grip units 17 allow the narrower width portion 10*a* to automatically penetrate through the positioning hole 11 is executed can be prevented. Consequently, the operation for allowing the narrower width portion 10*a* to penetrate through the positioning hole 11 can be automatized and its efficiency can be improved.

Figure 10A:
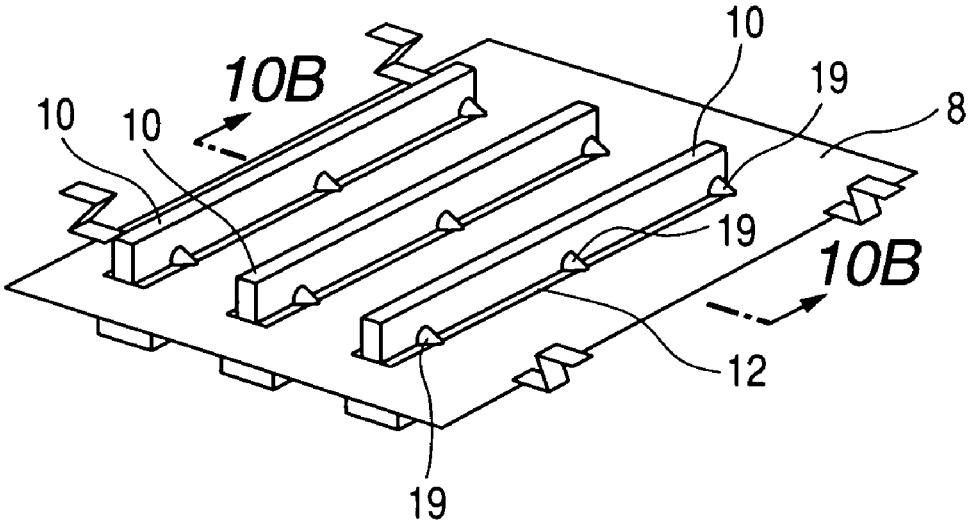
FIGS. 10A and 10B are explanatory diagrams showing a schematic structure of a part of the image displaying apparatus of another embodiment of the invention.
Figure 10B:
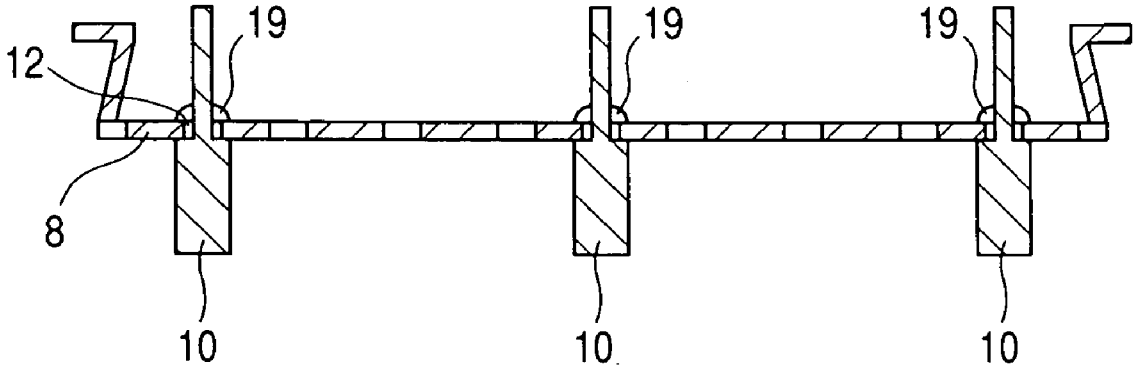

From a viewpoint of improving the working efficiency, it is also preferable that temporary fixing portions 19 to temporarily fix the spacer 10 and the electrode plate 8 are provided at a few points along the longitudinal direction of the spacer 10 as shown in FIGS. 10A and 10B in consideration of the working efficiency when the electrode plate 8 is handled in the state where the spacers 10 have been mounted.

As an example of a temporary fixing method, it is desirable to use a method whereby an inorganic adhesive agent is used for the temporary fixing portions 19 in consideration of a small quantity of degassing and a small amount of adhesive agent is potted by a dispenser or the like. FIG. 10A is a perspective view for explaining the electrode plate 8, spacer 10, and temporary fixing portions 19. FIG. 10B is a cross sectional view taken along the line 10B-10B in FIG. 10A. In FIGS. 10A and 10B, the component elements having substantially the same constructions as those shown in FIGS. 1A and 1B are designated by the same reference numerals.

The constructions shown in the diagrams in the embodiments described above are mere examples and the invention is not limited to them. For example, the invention is not limited to the electron-beam displaying apparatus (field-emission display (FED)) but can be also applied to other image displaying apparatuses.

According to the invention, in the manufacturing step, specifically speaking, at the time of a thermal step such as heating, cooling, or the like, since the spacer and the electrode plate are not fixed, the generation of the stress caused by the difference between the coefficients of thermal expansion of the spacer and the electrode plate can be prevented. Therefore, a risk that the spacer and the electrode plate are broken during the manufacturing step can be reduced. At the time of the operation of the displaying apparatus, since the electrode plate is pressed and fixed to the wider width portion of the spacer by the force of the electric field, the electrode plate can be easily fixed to the predetermined position at an extremely high precision equal to a shape precision of the spacer.

This application claims priority from Japanese Patent Application No. 2004-237165 filed Aug. 17, 2004, which is hereby incorporated by reference herein.

What is claimed is:

1. An image displaying apparatus comprising:

a first substrate having a first conductor set as a first electric potential;

a second substrate having a second conductor set as a second electric potential different from said first electric potential;

an electrode plate arranged between said first substrate and said second substrate and set as a third electric potential; and a spacer which has a narrower width portion and a wider width portion, penetrates through said electrode plate at said narrower width portion, fixes said electrode plate in said wider width portion, and defines a spacing between said first substrate and said second substrate, wherein the wider width portion of said spacer is located between said first substrate and said electrode plate and the following relation is satisfied:

$$V1/d1 > V2/d2$$

where,

V1: electric potential difference between the first electric potential and the third electric potential V2: electric potential difference between the second electric potential and the third electric potential d1: distance between the first substrate and the electrode plate d2: distance between the second substrate and the electrode plate.

2. An apparatus according to claim 1, wherein said first substrate has electron-emitting devices and said second substrate has phosphor members each for receiving irradiation of an electron emitted from said electron-emitting device and emitting light.

3. An apparatus according to claim 2, wherein said second conductor is a thin film conductor which covers said phosphor member.

4. An apparatus according to claim 1, wherein said electrode plate has a though hole though which the narrower width portion of said spacer penetrates, while said wider width portion does not penetrates though the through hole and fixes said electrode plate.

* * * * *

UNITED STATES PATENT AND TRADEMARK OFFICE

CERTIFICATE OF CORRECTION

PATENT NO. : 7,397,174 B2
APPLICATION NO. : 11/198230
DATED : July 8, 2008
INVENTOR(S) : Yasushi Shioya It is certified that error appears in the above-identified patent and that said Letters Patent is hereby corrected as shown below:

COLUMN 3

Line 34, “as” should read --at--.

COLUMN 10

Line 10, “though hole though” should read --through hole through--; and
Line 12, “penetrates though” should read --penetrate through--.

Signed and Sealed this

Thirtieth Day of December, 2008

JON W. DUDAS
*Director of the United States Patent and Trademark Office*